United States Patent [19]

Blanc

[11] Patent Number: 4,622,018

[45] Date of Patent: Nov. 11, 1986

[54] FLOATABLE COLLAR

[75] Inventor: Max A. Blanc, St. Jean de Luz, France

[73] Assignee: William B. Anderson, West Palm Beach, Fla. ; a part interest

[21] Appl. No.: 719,722

[22] Filed: Apr. 3, 1985

[51] Int. Cl.[4] ..... B63C 9/16

[52] U.S. Cl. ..... 441/123

[58] Field of Search ..... 441/123, 124, 104, 105; 119/96, 106

[56] References Cited

U.S. PATENT DOCUMENTS

| | | | |
|---|---|---|---|
| 1,442,746 | 1/1923 | Timberlake | 441/123 |
| 2,890,467 | 6/1959 | Cowell | 441/123 |
| 3,633,230 | 1/1972 | Horton | 441/123 |
| 3,842,806 | 10/1974 | McBride | 119/106 |

FOREIGN PATENT DOCUMENTS

| | | | |
|---|---|---|---|
| 2652404 | 5/1977 | Fed. Rep. of Germany | 441/123 |
| 308687 | 1/1937 | Italy | 441/124 |
| 490037 | 11/1936 | United Kingdom | 441/123 |

*Primary Examiner*—Trygve M. Blix
*Assistant Examiner*—Stephen P. Avila
*Attorney, Agent, or Firm*—Brumbaugh, Graves, Donohue & Raymond

[57] ABSTRACT

A floatable collar having a floatable chin bar to secure the collar on the neck of the swimmer and having an inflatable and expandable section to provide greater buoyancy and stability to the swimmer.

7 Claims, 3 Drawing Figures

FLOATABLE COLLAR

BACKGROUND OF THE INVENTION

This invention relates to a floatable safety device for keeping a swimmer's head afloat, and more particularly to a novel floatable collar having a floatable chin bar which can be adjusted relative to the collar to secure the collar on the neck of the swimmer with the floatable chin bar adjusted under the swimmer's chin.

The floatable collar has been designed anatomically for comfort and so as not to strangle the swimmer while allowing him freedom of motion both above and below the water. When he relaxes, the collar will float around his neck with his chin supported by the floatable chin bar, tilting his head backwards and keeping his nose and mouth out of the water so that he can breathe and call for help.

The floatable collar of the present invention includes an inflatable and expandable accordian section in front of the face of the swimmer which the swimmer can easily grasp and bring to his mouth to inflate while the collar is secured in place. The inflated accordian section will increase the buoyancy provided by the collar to keep the swimmer's nose and mouth out of the water and provide increased stability to prevent the swimmer from turning his face into the water.

The inflatable safety collar of the present invention provides a compact floatable device that can be worn comfortably and without undue inconvenience. Also, it can be easily carried or stored.

For a complete understanding of the invention, reference can be made to the detailed description that follows and to the accompanying drawings in which.

Figure 1:
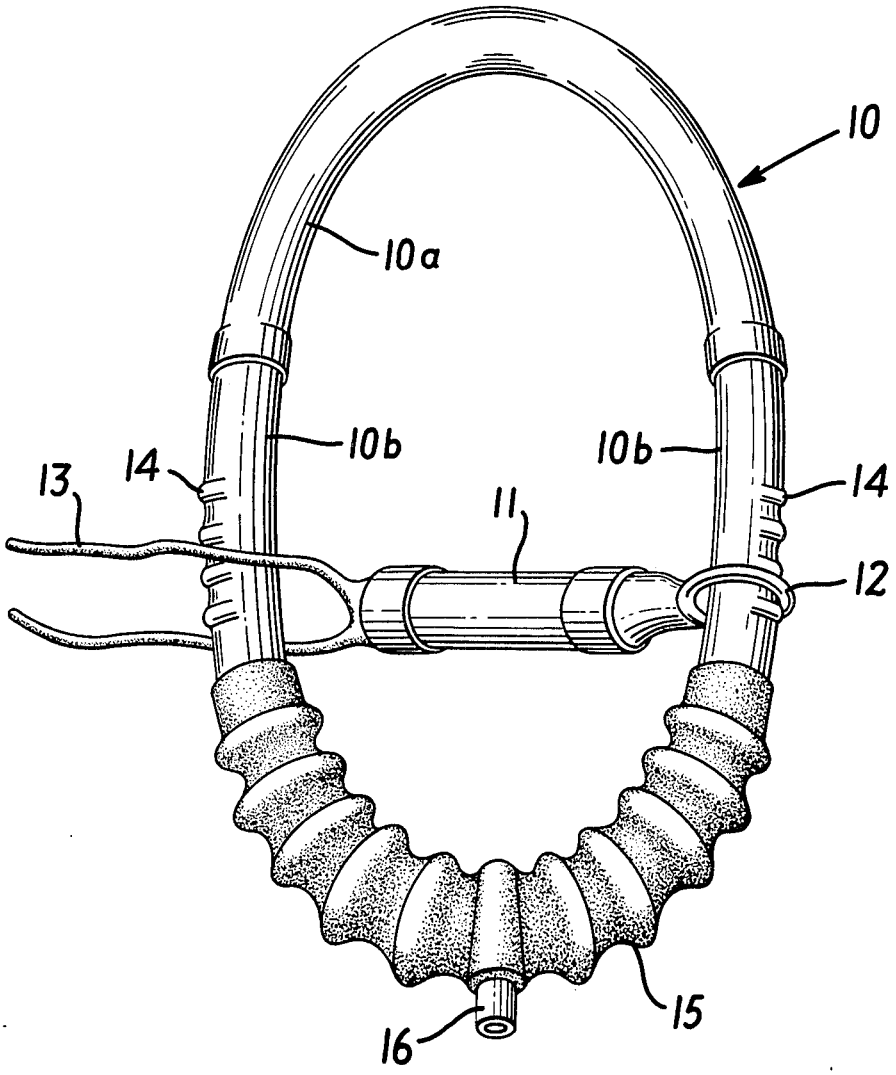
FIG. 1 is a perspective view of the floatable safety collar of the present invention.
Figure 2:
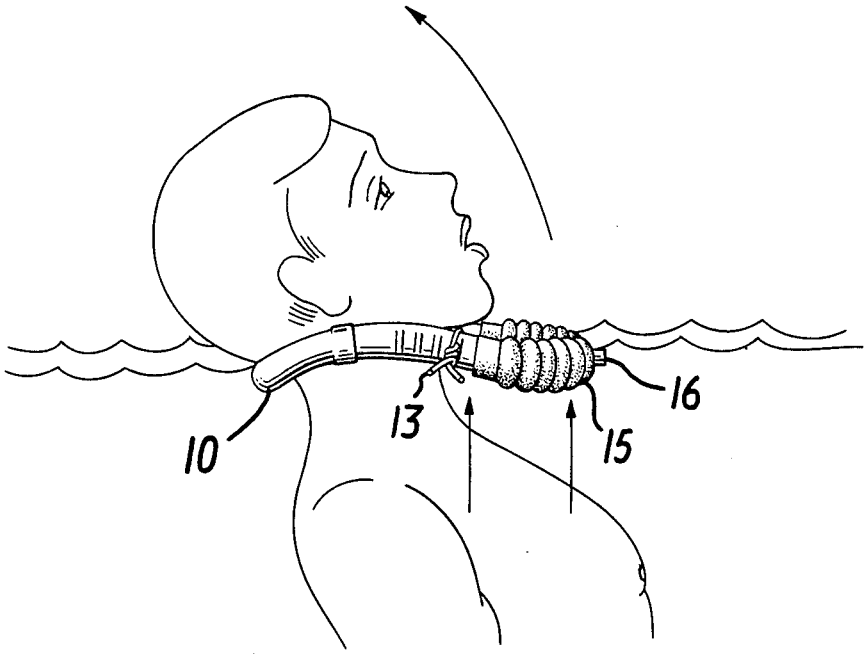
FIG. 2 shows the collar worn by a swimmer, viewed from the side of the swimmer.
Figure 3:
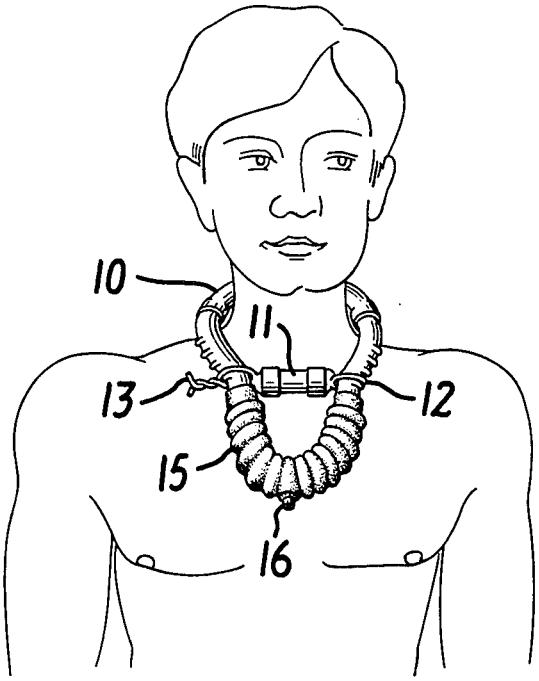
FIG. 3 shows the safety collar worn by a swimmer, viewed from the front of the swimmer.

The floatable safety device of the present invention, as shown in FIG. 1, includes a hollow floatable collar 10 which can be worn on the neck of the swimmer, as shown in FIGS. 2 and 3. The collar is oversized so that it can be easily placed on the wearer's neck.

The collar accommodates a hollow floatable chin bar 11 which subdivides the collar and cooperates with the neck engaging section 10*a* of the collar to insure that the collar will not be disengaged from the neck of the swimmer. The ends of the chin bar are adjustable along sections 10*b* of the collar so that the chin bar can be adjusted and retained underneath the swimmer's chin to keep the swimmer's head afloat.

The chin bar 11 is connected at one end to the collar by a ring 12 which is in sliding relationship with the collar and at the other end by a yoke formed between a pair of prongs or straps 13 which yoke is in sliding relationship with the collar until the prongs are tied or twisted around the collar to hold the chin bar firmly in place. To facilitate retention of the chin bar in its adjusted position, the opposite sections 10*b* of the collar are formed with a plurality of spaced apart circumferential ridges or protrusions 14 which lock the ring 12 and the fastened prongs 13 securely in place without slippage relative to the collar.

When the collar is placed around the neck of the swimmer, the chin bar 11 is adjusted by sliding the ring and yoke to a comfortable position. The prongs 13 can then be tied or twisted tightly around the section of the collar to secure the chin bar. The prongs or straps 13 may be flexible, but preferably they are relatively stiff and bendable so that in case of emergency they can be quickly adjusted to the desired position and secured by a twisting action to quickly lock the chin bar in place.

The section of the collar opposite the neck engaging section 10*a* is an inflatable and expandable accordian section 15 having a check valve 16 at the center. The inflatable and expandable accordian section 15 of the collar is directly in front of the swimmer's face, so that he can easily grasp it and bring the valve to his mouth to enable him to inflate the expandable section. The expandable section, when inflated, will provide additional buoyancy to keep the swimmer afloat and at the same time cooperate with the floatable chin bar to keep his head tilted backwards and his nose and mouth out of the water permitting him to breath and call for help. The collar, thus inflated, will stabilize the swimmer's head and prevent him from turning his face into the water.

The collar is preferably made in sections, namely, the U-shaped tubular section 10*a* which encircles the back of the swimmer's neck, the pair of tubular sections 10*b* in tight fitting, telescoping relationship with the ends of section 10*a* for the support of the adjustable chin bar 11 and the inflatable and expandable accordian section 15 in tight fitting, telescoping relationship with the sections 10*b*. The tubular sections 10*a* and 10*b* and the hollow chin bar 11 are preferably made of rigid plastic, water-tight material. The expandable accordian section 15 is preferably made of a suitable water-tight, resilient and elastic material.

Both the collar and chin bar will float and give buoyancy to the swimmer even before the expandable accordian section 15 is inflated, so that the swimmer need only adjust the chin bar in place and tie or twist the prongs 13 to give him support. In this adjustement, the floatable collar will automatically rise to its chin supporting position before the prongs 13 are tied or twisted.

This invention has been shown in a single preferred embodiment and by way of example, and many variations and modifications can be made therein within the spirit of the invention. The invention, therefore, is not intended to be limited to any specific form or embodiment, except as such limitations are explicitly set forth in the claims.

I claim:

1. A floatable safety device comprising a floatable collar capable of being placed around the neck of a swimmer, said collar including a non-inflatable, relatively rigid U-shaped portion that extends around the back of the swimmer's neck and an inflatable and expandable tubular portion that connects the ends of the U-shaped portion, a buoyant, hollow chin bar subdividing the collar so that a subdivided portion of the collar which excludes the inflatable and expandable portion encircles the swimmer's neck to provide buoyancy to help keep the swimmer's head afloat without disengaging the collar from the neck of the swimmer, and means connecting the ends of the chin bar across the U-shaped portion for adjustment relative to the said U-shaped portion of the collar to facilitate tightening of the collar and chin bar around the swimmer's neck.

2. A floatable safety device as set forth in claim 1 in which the inflatable and expandable portion of the collar is the portion subdivided by the chin bar that is in front of the swimmer's face and in front of the chin bar.

3. A floatable safety device as set forth in claim 1 in which the chin bar is adjustably connected at one end along the axis of the collar and is detachably connected at the other end to the collar.

4. A floatable safety device as set forth in claim 3 in which the adjustable end of the chin bar is a ring and the detachable end of the chin bar is a yoke defined by a pair of bendable prongs.

5. A floatable safety device as set forth in claim 1 in which the inflatable and expandable part of the collar is an accordian shaped elastic section.

6. A floatable safety device as set forth in claim 1 including valve means forming part of the collar to inflate the inflatable and expandable part of the collar.

7. A floatable safety device as set forth in claim 1 including means on the collar for retaining the ends of the chin bar in adjusted position.

* * * * *